US009194138B2

(12) United States Patent
Gower et al.

(10) Patent No.: US 9,194,138 B2
(45) Date of Patent: Nov. 24, 2015

(54) DRYWALL INSTALLATION TOOL AND A METHOD FOR ITS USE

(71) Applicants: Timothy A. Gower, Warminster, PA (US); Ryan P. Malone, Warrington, PA (US)

(72) Inventors: Timothy A. Gower, Warminster, PA (US); Ryan P. Malone, Warrington, PA (US)

( * ) Notice: Subject to any disclaimer, the term of this patent is extended or adjusted under 35 U.S.C. 154(b) by 0 days.

(21) Appl. No.: 13/940,295

(22) Filed: Jul. 12, 2013

(65) Prior Publication Data

US 2014/0013703 A1 Jan. 16, 2014

Related U.S. Application Data

(60) Provisional application No. 61/670,722, filed on Jul. 12, 2012.

(51) Int. Cl.
*E04F 21/18* (2006.01)

(52) U.S. Cl.
CPC ..... *E04F 21/18* (2013.01); *E04F 21/1805* (2013.01); *E04F 21/1822* (2013.01); *E04F 21/1844* (2013.01); *E04F 21/1894* (2013.01); *Y10S 269/904* (2013.01)

(58) Field of Classification Search
CPC ..... E04F 21/185; E04F 21/1855; E04F 21/18; E04F 21/1822; E04F 21/1805; E04F 21/1894; E04F 21/1844; E04G 21/16; Y10S 269/904; Y10S 52/01; B25B 7/123; B66D 1/28; B66F 9/02; E04B 9/003; F16M 13/02; F16M 13/027; E04G 21/168
USPC ..... 52/749.1, 749.11, 127.2; 248/241, 250, 248/247, 235, 231.41
See application file for complete search history.

(56) References Cited

U.S. PATENT DOCUMENTS

| | | | | | |
|---|---|---|---|---|---|
| 4,158,455 | A | * | 6/1979 | Brown | 269/102 |
| 4,485,543 | A | * | 12/1984 | Flores et al. | 29/281.1 |
| 5,371,994 | A | * | 12/1994 | Waters | 52/749.1 |
| 5,388,813 | A | * | 2/1995 | Arsenault | 269/41 |
| 5,658,113 | A | * | 8/1997 | Lazo | 414/11 |
| 5,700,123 | A | * | 12/1997 | Rokosh et al. | 414/11 |
| 5,732,527 | A | * | 3/1998 | Schneider | 52/749.1 |
| 5,771,991 | A | * | 6/1998 | Fresco | 182/82 |

(Continued)

FOREIGN PATENT DOCUMENTS

| | | |
|---|---|---|
| EP | 1 114 903 A2 | 6/2001 |
| GB | 2 236 349 B2 | 10/1993 |
| GB | 2 346 651 A | 8/2000 |

*Primary Examiner* — Brian Glessner
*Assistant Examiner* — Babajide Demuren
(74) *Attorney, Agent, or Firm* — Muskin & Farmer, LLC; Shawn R. Farmer; Jon H. Muskin

(57) ABSTRACT

The present drywall installation tool is configured to facilitate the installation of drywall panels to wall or ceiling structures and to avoid the necessity of having more than one person to install each drywall panel. Specifically, the installation tool can comprise a clamping section and a shelf section. The clamping section can be used to secure the installation tool to wall studs or ceiling joists and can comprise at least one fixed-arm and at least one sliding-arm. The shelf section can be configured to support a drywall panel horizontally or vertically, relative to the ground, depending upon how the installation tool is positioned. The shelf section can comprise a shelf having a flange that can help support the drywall panel. The installation tool can be configured to support the weight of a drywall panel, allowing a single person to install drywall panels comprising either wall or ceiling structures.

17 Claims, 8 Drawing Sheets

(56) References Cited

U.S. PATENT DOCUMENTS

| | | | | |
|---|---|---|---|---|
| 5,918,843 | A * | 7/1999 | Stammers | 248/230.6 |
| 6,293,058 | B1 | 9/2001 | Sink | |
| 6,467,236 | B1 | 10/2002 | Schlegel | |
| 6,904,732 | B1 | 6/2005 | Richmond | |
| 2002/0101016 | A1 | 8/2002 | Johnston | |
| 2002/0170248 | A1 * | 11/2002 | Fara | 52/202 |
| 2004/0182019 | A1 * | 9/2004 | Flynn | 52/127.2 |
| 2005/0166484 | A1 | 8/2005 | Richmond | |
| 2006/0053722 | A1 | 3/2006 | Gwynn | |
| 2006/0137290 | A1 * | 6/2006 | Boucher | 52/749.1 |
| 2006/0260219 | A1 * | 11/2006 | Riddle et al. | 52/127.2 |
| 2008/0040988 | A1 * | 2/2008 | Holt | 52/127.2 |
| 2008/0110107 | A1 * | 5/2008 | Decker | 52/127.2 |
| 2008/0209850 | A1 * | 9/2008 | Boucher et al. | 52/745.05 |
| 2011/0265423 | A1 | 11/2011 | Richmond | |
| 2012/0222385 | A1 | 9/2012 | Matthews | |
| 2012/0222386 | A1 | 9/2012 | Matthews | |
| 2013/0199124 | A1 * | 8/2013 | Roberts | 52/749.1 |

* cited by examiner

DRYWALL INSTALLATION TOOL AND A METHOD FOR ITS USE

CROSS REFERENCE TO RELATED APPLICATIONS

This application claims benefit to provisional patent application No. 61/670,722 filed Jul. 12, 2012, which is incorporated by reference herein in its entirety.

FIELD OF THE INVENTION

The present device relates to tools that can be used to install drywall panels and similarly shaped structures and a method for using such tools.

BACKGROUND

Drywall, also known as plasterboard, wallboard, or gypsum board, is a type of paneling that is commonly used to construct the interior walls and ceilings of houses, offices and other buildings. Drywall is typically made up of an inner core of gypsum plaster pressed between two thick sheets of paper and can be manufactured in various lengths and thicknesses for use in many different applications. A standard drywall sheet is commonly four (4) feet wide and eight (8) feet long and one-half (½) inch thick, but can also be up to twelve (12) feet long, and three-eighths (⅜ths) to five-eighths (⅝ths) inches thick. To install drywall panels, each panel is cut into desired shapes and sizes and then secured to wall or ceiling structures with nails, glue, screws or other suitable fasteners. Cutouts in each drywall panel can be made for wall features such as windows, doors, plumbing, electrical outlets and light switches. After the panels have been secured to the wall or ceiling structure, the seams between the drywall panels are concealed and the outer surface of the panels can be finished with a plaster coating and painted or covered with wallpaper or other coverings.

Multiple panels or sheets of drywall are commonly required to completely cover a single wall or ceiling. Such installations typically require more than one worker to complete, as it is often necessary for one worker to hold a drywall panel in place while a second worker secures the panel to the underlying wall studs or ceiling joists. Requiring more than one worker to install each drywall panel prolongs the time it takes to complete the construction job as other work must be put on hold so that at least two workers can assist each other with the drywall installation. This reduces efficiency which inevitably leads to higher construction costs.

One solution intended to alleviate the burden of installing multiple panels of drywall has been to use a panel hoist tool (See U.S. Pat. No. 5,700,123 by Rokosh et al. for example.) that can lift each drywall panel to the proper placement position for installation. The panel hoist can allow one person to handle and install drywall panels to either walls or ceilings, avoiding the need for assistance from a second person. However, purchasing or even renting a panel hoist can be expensive and may not be conducive for drywall installation in smaller spaces. Additionally, such panel hoists are typically large and unwieldy pieces of equipment that can be difficult to properly position and move around a worksite. Therefore, any time that is saved by requiring only one person to operate the panel hoist will likely be lost due to the time necessary to move the panel hoist around the construction site and the time required to place it into the positions required to install each sheet of drywall if such positioning is possible at all.

What is needed is a drywall installation tool configured to be used by a single person to install drywall panels onto walls and ceilings. Specifically, this drywall installation tool should allow one person to install a drywall panel without requiring the assistance of another person to either hold the panel in place or secure it to a wall or ceiling once it is in place. Furthermore, this drywall installation tool should be easy to move around a construction site and capable of being quickly moved into any position required to install a particular piece of drywall to a wall or ceiling.

SUMMARY OF THE INVENTION

The above aspects can be obtained by a drywall installation tool comprising: a clamping section comprising a horizontal bar, at least one fixed-arm immovably connected to the horizontal bar, and at least one sliding-arm movably connected to the horizontal bar; a shelf section comprising a shelf having an inner edge and an outer edge; and a locking mechanism configured to securely connect the sliding-arm at chosen points along the horizontal bar.

The above aspect can also be obtained by a drywall installation tool comprising: a clamping section comprising a horizontal bar; at least one fixed-arm immovably connected to the horizontal bar, and at least one sliding-arm movably connected to the horizontal bar; a shelf section comprising a shelf having an inner edge and an outer edge, wherein the shelf section is configured to pivot between an up position to a down position; and a locking mechanism configured to securely connect the sliding-arm at chosen points along the length of the horizontal bar.

The above aspect can also be obtained by a method for using a drywall installation tool comprising: providing a drywall installation tool comprising a clamping section further comprising a horizontal bar; at least one fixed-arm immovably connected to the horizontal bar, and at least one sliding-arm movably connected to the horizontal bar; a shelf section comprising a shelf having an inner edge and an outer edge; and a locking mechanism configured to securely connect the sliding-arm at chosen points along the length of the horizontal bar; providing a section of drywall; providing a wall structure comprising at least one stud, each stud comprising a first side and a second side; providing at least one fastener; connecting the drywall installation tool to at least one stud by positioning the fixed-arm against the first side of a stud and moving the sliding-arm along the horizontal bar until it contacts the second side of a stud and activating the locking mechanism to securely connect the sliding-arm to the horizontal bar at a selected location; and placing the section of drywall on the shelf and connecting the drywall section to at least one stud with at least one fastener.

Further features and advantages of the present device, as well as the structure and operation of various embodiments of the present device, will become apparent and more readily appreciated from the following description of the preferred embodiments, taken in conjunction with the accompanying drawings of which:

DETAILED DESCRIPTION

Figure 1:
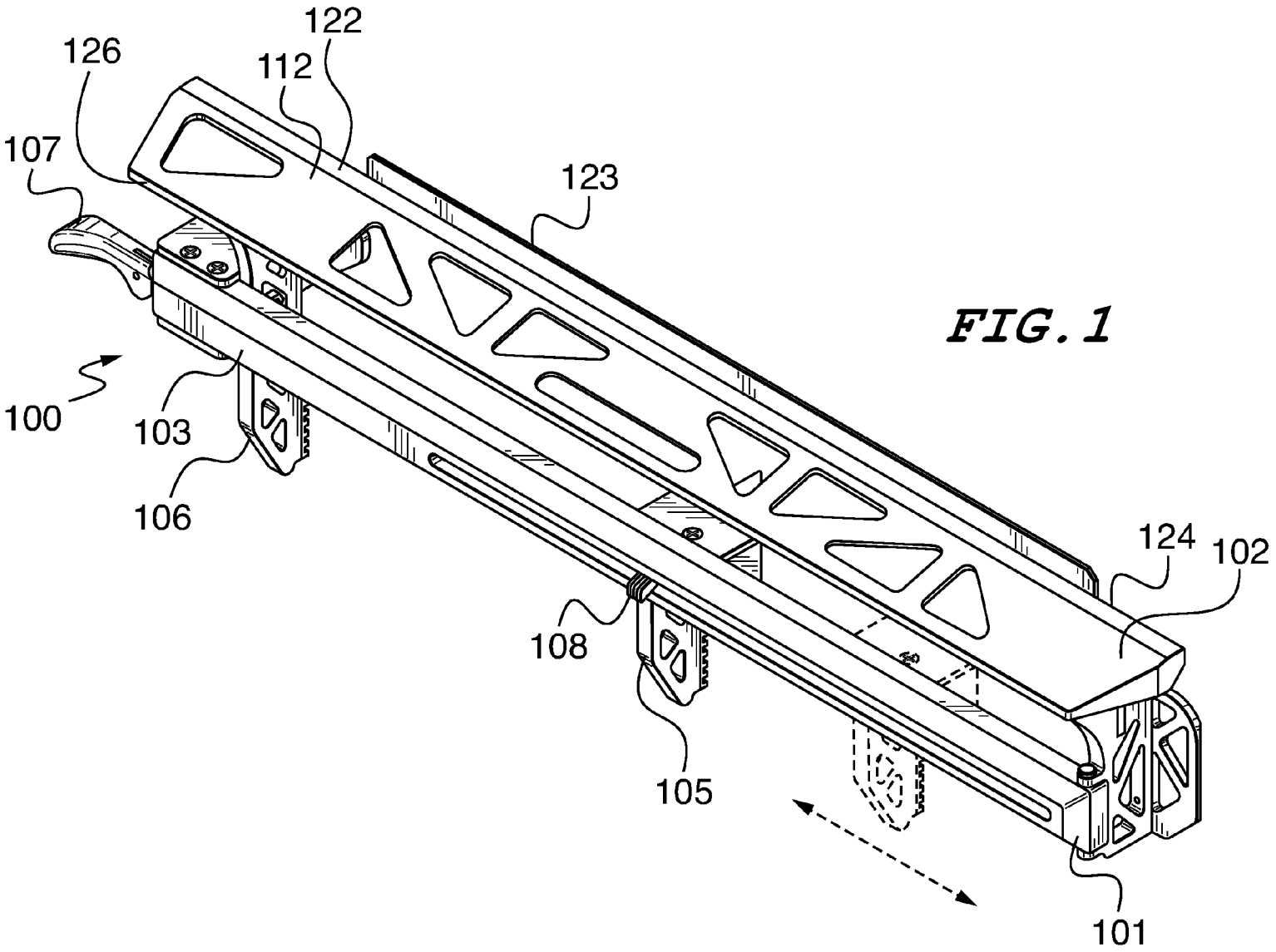
FIG. 1 is a perspective front, top and right-side view of a drywall installation tool according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present drywall installation tool is configured to support a standard sheet of drywall against and adjacent to wall studs or ceiling joists. Specifically, the present drywall installation device can act as a movable support ledge configured to secure one edge of a sheet of drywall allowing the user to free one or both of his or her hands to secure the drywall to the studs or joists using nails, screws or other suitable fastening devices. According to an embodiment, the present device can comprise a clamping mechanism allowing it to be removably connected to the wall studs or ceiling joists comprising a wall or ceiling respectively. In an embodiment, this clamping mechanism can resemble a bar clamp comprising two or more arms wherein at least one of these arms can be moved along the bar. These arms can be moved closer together to connect the drywall installation tool to the studs or joist or moved apart to release the tool from the studs or joists, according to an embodiment. The clamping mechanism can be configured so that it can be mounted flush against the studs or joists to which the drywall panel is being connected.

In an embodiment, the drywall installation tool can comprise a shelf configured to support a sheet of drywall. This shelf can be connected to the clamping mechanism and can be rotatable in order to facilitate the connection of drywall panels to a ceiling. In an embodiment, this drywall installation tool can be approximately three (3) feet long and one (1) foot wide and can weight approximately ten (10) pounds.

Reference will now be made in detail to the present embodiments of the drywall installation tool, examples of which are illustrated in the accompanying drawings, wherein like reference numerals refer to like elements throughout FIG. 1 is a perspective front, top and right-side view of a drywall installation tool 100 according to an embodiment. The drywall installation tool 100 can comprise a clamp section 101 and shelf section 102. In an embodiment, the clamp section 101 can comprise a horizontal bar 103. At least one sliding-arm 105 can be movably secured to the horizontal bar 103 allowing the sliding-arm 105 to move along the horizontal bar 103. The capacity to move the sliding-arm 105 can allow the drywall installation tool 100 to be secured to wall structures or ceiling structures at chosen locations and can allow the drywall installation tool 100 to be secured to wall studs or ceiling joist (not shown in FIG. 1) having a range of centers (distances between each joist or stud).

The clamp section 101 can comprise a locking lever 107 at one side of the horizontal bar 103. The locking lever 107, when placed into an open position, can allow the sliding-arm 105 to be positioned at various locations along the horizontal bar 103. The locking lever 107, when placed into a closed position (not shown in FIG. 1), can be used to secure the sliding-arm 105 into a certain position selected by the user. In an embodiment, the clamp section 101 can comprise at least one fixed-arm 106. In an embodiment, each fixed-arm 106 can be immovably connected to the horizontal bar 103 at one end of the clamp section 101 opposite the end closest to the sliding-arm 105.

The shelf section 102 of the drywall installation tool 100 can comprise a shelf 112 which can extend along the distance of the horizontal bar 103 of the clamp section 101. In an embodiment, the shelf 112 can comprise a flange 122 at or near an inside edge 124 of the shelf section 102, which can be the edge positioned nearest wall studs or ceiling joists when the drywall installation tool 100 is connected to the wall studs or ceiling joists (not shown in FIG. 1). In an embodiment, the shelf 112 can comprise a panel guide 123 that can be connected to the flange 122. The shelf 112 can slope downward from the flange 122 to an outside edge 126. This slope of the shelf 112 up to the flat flange 122 can allow for easier placement of a drywall panel (not shown in FIG. 1) by allowing the drywall panel's edge to be slid along the slope of the shelf 112 until it is supported by the flat surface of the flange 122. Once the drywall panel's edge is supported by the flange 122, the drywall panel can be fastened to the wall or ceiling to which the drywall installation tool 100 has been connected.

In an embodiment, a user can initially position the drywall installation tool 100 against wall studs or ceiling joists while the locking lever 107 is in the open position. Once the sliding-arm 105 and the fixed-arm 106 are each in their desired positions, the user can place the locking lever 107 into the closed position, thus moving the sliding-arm 105 closer to the fixed-arm 106 as well as towards, and more firmly against, the wall studs or ceiling joists located between the sliding-arm 105 and fixed-arm 106. The inward pressure exerted by both the sliding-arm 105 and the fixed-arm 106 can thus securely connect the drywall installation tool 100 to the wall studs or ceiling joists in a desired location.

In an embodiment, the sliding-arm 105 can comprise a clamp release button 108 which can allow the user to move the sliding-arm 105 across the clamp section 101 so as to position the fixed-arm 106 against one wall stud or ceiling joist and the sliding-arm 105 against another wall stud or ceiling joist. In this embodiment, moving the locking lever 107 into the closed position can create the final movement of the sliding-arm 105 toward the fixed-arm 106. However, most of the movement of the sliding-arm 105 would be accomplished by the full release of the sliding-arm 105 controlled by the release button 108.

The user can use the drywall installation tool 100 as an aid in installing a drywall panel to a wall or ceiling. In an embodiment, the user can place a drywall panel in a vertical position, against a stud wall, and this drywall panel can be supported by direct contact with the flange 122 of the shelf 112 comprising the shelf portion 102 of the installation tool 100 when installing drywall on a wall. In an embodiment, the user can place a drywall panel horizontally against selected ceiling joists and the drywall panel can be supported by the flange 122 of the shelf 112 comprising the shelf portion 102 for installation of drywall onto a ceiling.

In an embodiment, the weight of the drywall panel can be supported fully by the drywall installation tool 100 allowing the user to use one hand to hold the panel in place while the user's other hand is free to secure the drywall panel to the wall or ceiling with one or more fasteners. In this way, the drywall installation tool 100 can allow a single user to install a drywall panel as the drywall installation tool 100 can substantially perform the function of a second person who typically assists the first person by holding the drywall panel in place while the first person secures the panel to the wall or ceiling using screws or nails. Alternatively, the drywall installation tool 100 can be used to support the weight of the drywall panel while the user can use one hand to hold the panel against a wall or ceiling while using the other hand to install nails or screws to connect the panel to the studs or joists.

The drywall installation tool 100 can be comprised in full or in part of any suitable material such as carbon fiber, aluminum or plastic to name a few examples of suitable materials. As mentioned above, the drywall installation tool 100 can measure approximately three (3) feet in length and have a width of approximately one (1) foot. However, the measurement specifications of the drywall installation tool 100 can be customized to suit the structural dimensions of various walls and ceilings as well as the space limitations in the rooms where the wall and ceiling panels are to be installed.

Figure 2:
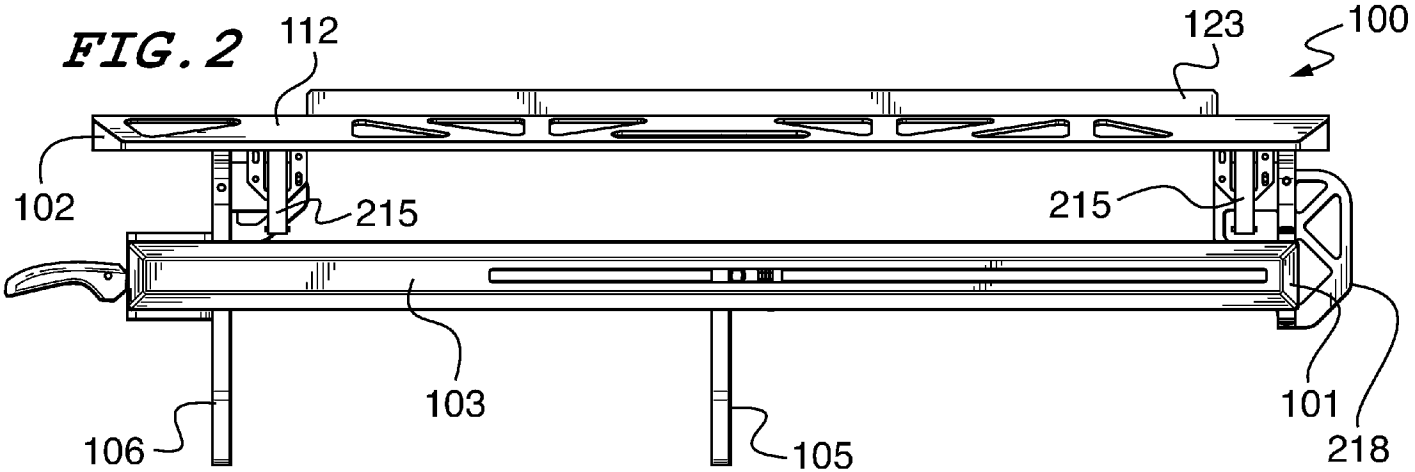
FIG. 2 is a front view of a drywall installation tool according to an embodiment.

FIG. 2 is a front view of a drywall installation tool 100 according to an embodiment. This view shows more clearly the spatial relationship that can exist between the clamping section 101 and the shelf section 102. In this embodiment, the shelf section 102 and the clamping section 101 are oriented into planes that are parallel to one another. This view also shows the relative positions of both the fixed-arm 106 and the sliding-arm 105 in relation to the horizontal bar 103. This view also shows the panel guide 123, which is configured to act as a spacer to prevent the user from mounting the shelf 112 too close to the ceiling joists according to an embodiment. In an embodiment, the panel guide 123 can extend approximately three fourths (¾ths) of an inch from the top surface of the shelf 112 in order for a user to set any drywall panel having a thickness of up to three fourths (¾ths) inches on the shelf 112 without requiring the adjustment of the height of the shelf 112. Alternative embodiments of the drywall installation tool 100 may not comprise a panel guide 123, as the core function of the tool could be accomplished without it.

In an embodiment, the drywall installation tool 100 can also comprise a supplemental stabilizer 218 configured to increase the surface area contact between the drywall installation tool 100 and the wall or ceiling structure to which it is connected. According to an embodiment, the movement of the shelf 112 can be facilitated by the use of one or more hinges 215. These hinges 215 can be locking hinges configured to hold the shelf 112 in a selected position unless and until significant force is applied to move it from one position to another. In an embodiment, these positions can include an up position and a down position, which are each described in more detail below. In FIG. 2, the shelf 112 is shown in the down position.

Figure 3:
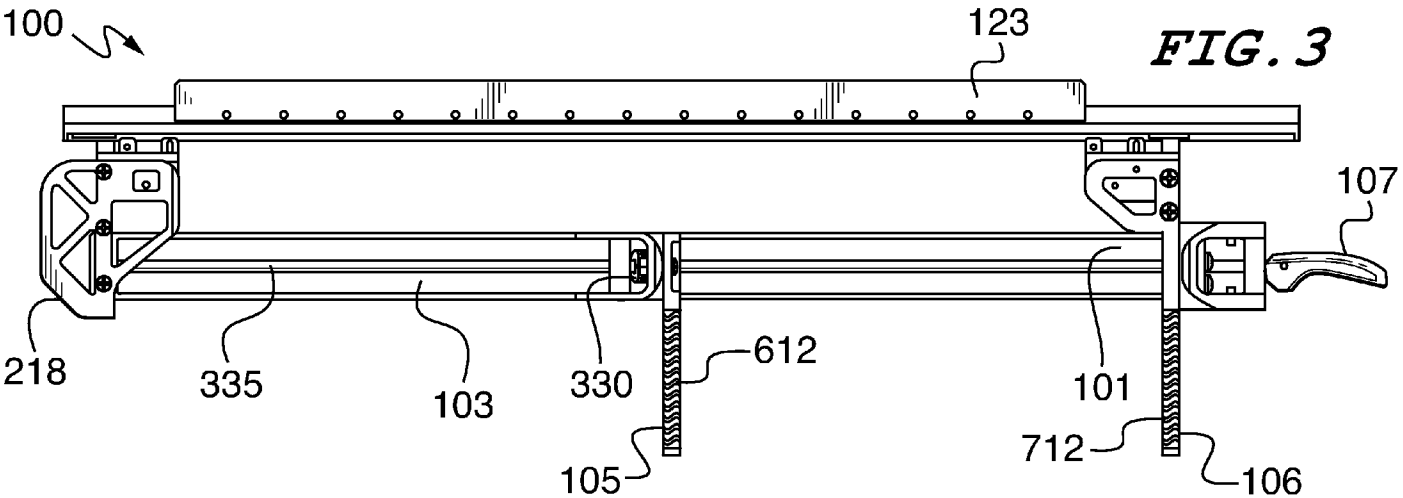
FIG. 3 is a rear view of a drywall installation tool according to an embodiment.

FIG. 3 is a rear view of a drywall installation tool 100 according to an embodiment. This view shows the inner workings of the clamping section 101 according to this particular embodiment. Specifically, a draw bar 335 is shown to extend along the length of the horizontal bar 103 and connect at one end to the locking lever 107. The sliding-arm 105 can be connected to the draw bar 335 and the sliding-arm 105 can be secured to a point along the draw bar 335 when the locking lever 107 is placed into a closed position (not shown in FIG. 3). When the locking lever 107 is placed in an open position (as shown in FIG. 3), and the release button 108 (not visible in FIG. 3) is pressed, the sliding-arm 105 can be allowed to move along the length of the draw bar 335. The draw bar locking mechanism 330, which can be controlled by the release button 108, can also be used to lock the sliding-arm 105 to the draw bar 335.

FIG. 3 also shows the sliding-arm stabilizer 612, comprising the sliding-arm 105, and the fixed-arm stabilizer 712, comprising the fixed-arm 106, to be viewed. The purpose of these two stabilizers, 612 and 712, is discussed in more detail below. In an embodiment, the drywall installation tool 100 can also comprise a supplemental stabilizer 218 configured to increase the surface area contact between the drywall installation tool 100 and the wall or ceiling structure to which it is connected. The connection of the panel guide 123 to the drywall installation tool 100 can be seen as FIG. 3, according to an embodiment.

Figure 4:
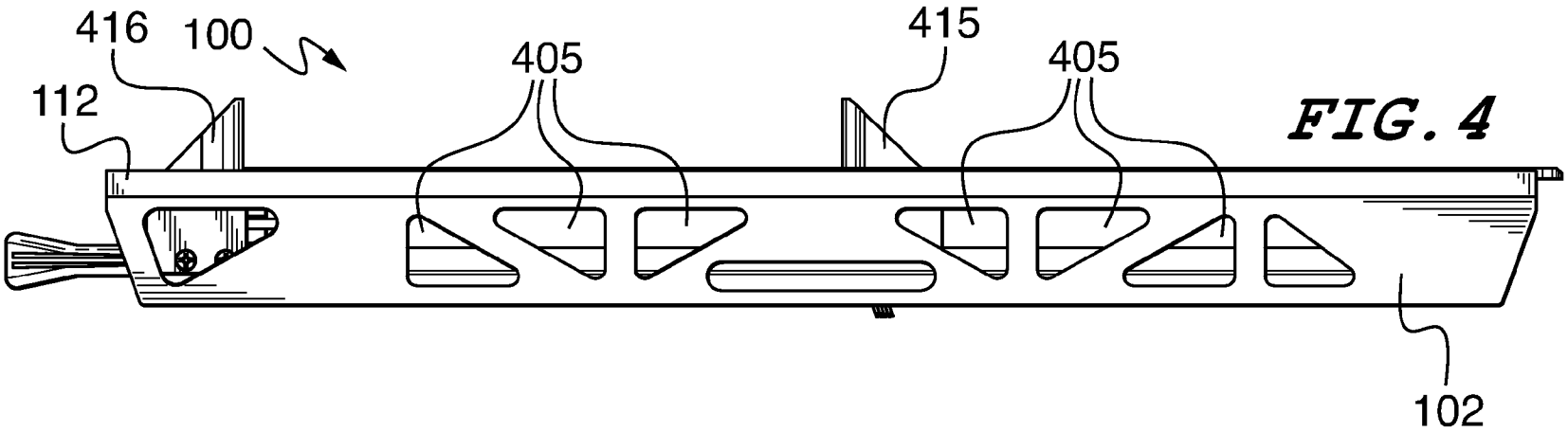
FIG. 4 is a top view of a drywall installation tool according to an embodiment.

FIG. 4 is a top view of a drywall installation tool 100 according to an embodiment. The shelf section 102 can comprise one or more cut-outs 405, making the shelf 112 non-solid. The cut-outs 405 can comprise various shapes and their purpose can be to decrease the overall weight of the drywall installation tool 100, allowing it to be more easily maneuvered as well as to reduce friction between an edge of a piece of wallboard and the shelf 112 as the wallboard is slid over the shelf 112 for installation. This improved maneuverability can improve functionality of the drywall installation tool 100 by allowing a user to more easily connect it to wall or ceiling structures.

In this figure, both the sliding-arm grip 415 and the fixed-arm grip 416 can also be viewed. The sliding-arm grip 415 can be the portion of the sliding-arm 105 that extends into a wall or ceiling structure and can be the portion that comes into direct contact with the wall studs, ceiling joists, or similar objects to which the drywall installation tool 100 is being connected. Likewise, the fixed-arm grip 416 can be the portion of the fixed-arm 106 that extends into a wall or ceiling structure and can be the portion that comes into direct contact with the wall studs, ceiling joists, or similar objects to which the drywall installation tool 100 is connected. Although only one fixed-arm grip 416 and only one sliding-arm grip 415 are shown in FIG. 4, it is contemplated that each drywall installation tool 100 can comprise more than one sliding-arm grip 415 and more than one fixed-arm grip 416.

Figure 5:
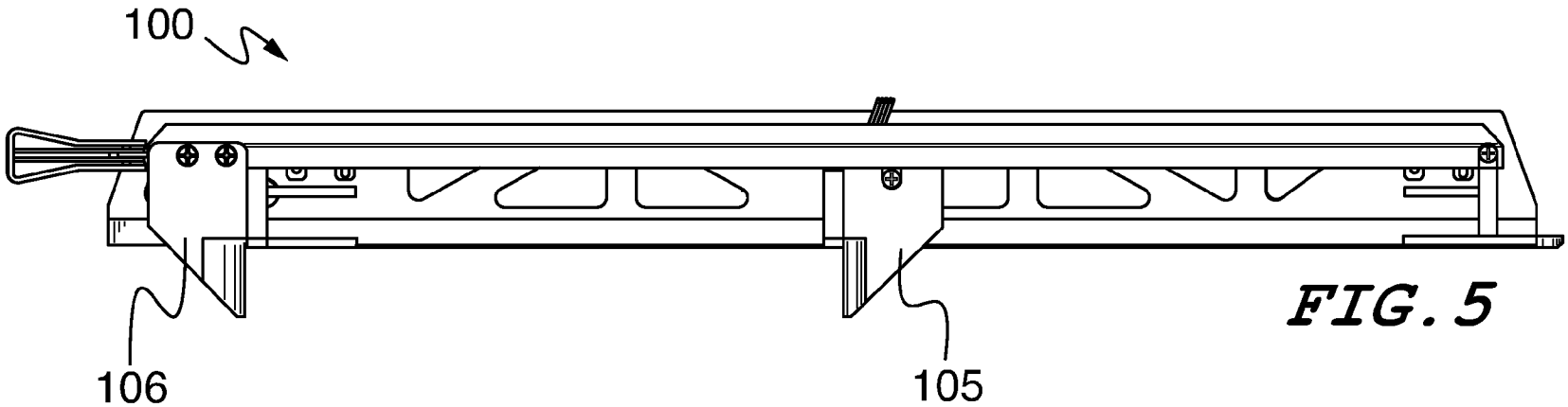
FIG. 5 is a bottom view of a drywall installation tool according to an embodiment.

FIG. 5 is a bottom view of a drywall installation tool 100 according to an embodiment. This view clearly shows both the fixed-arm 106 and the sliding-arm 105 which comprise the points of connection between the drywall installation tool 100 and the wall studs or ceiling joists to which it is configured to be connected.

Figure 6:
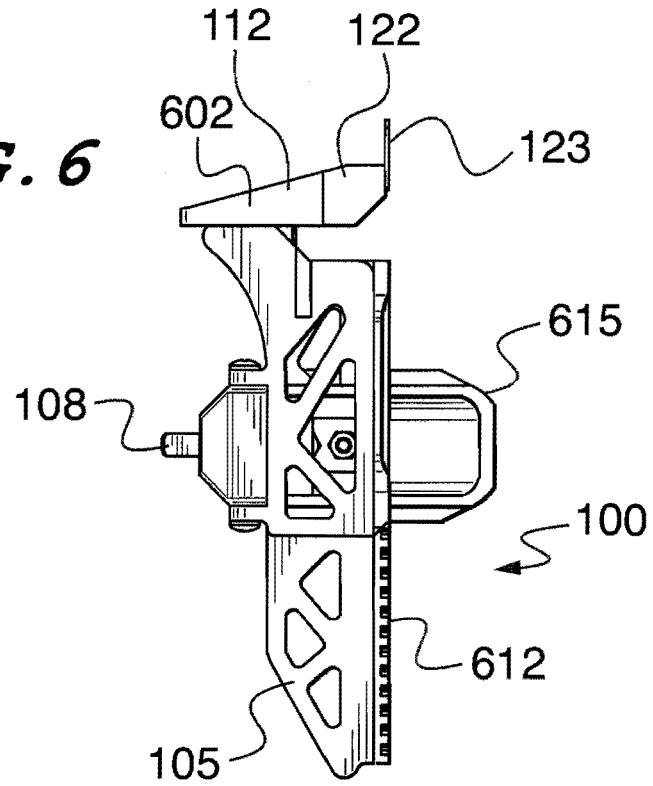
FIG. 6 is a right-side view of a drywall installation tool wherein the shelf is in a down position according to an embodiment.

FIG. 6 is a right-side view of a drywall installation tool 100 wherein the shelf 112 is shown in a "down position" 602 according to an embodiment. In an embodiment, the down position 602 of the shelf 112 can allow a user to install drywall onto a wall or similar vertical structure. The user can position the sliding-arm 105 and the fixed arm (not shown) in the proper position against the wall studs and can lock the installation tool 100 into place using the locking lever 107 (not shown in FIG. 6). In an embodiment, the sliding-arm 105 can comprise a clamp release button 108 which can allow the user to move the sliding-arm 105 so as to position the fixed-arm 106 (not shown in FIG. 6) against one wall stud or ceiling joist and the sliding-arm 105 against another wall stud or ceiling joist or against a second side of the same wall stud or ceiling joist. To ensure that the drywall installation tool 100 is securely connected to the wall studs or ceiling joists (not shown in FIG. 6) at a proper angle, the sliding-arm 105 can also comprise a sliding-arm stabilizer 612 located below a sliding-arm gripping ear 615, according to an embodiment. This sliding-arm stabilizer 612 can be configured to rest against the stud or joist to which the sliding-arm gripping ear 615 is connected, thus maintaining the position of the drywall installation tool 100 in a plane parallel to the wall or ceiling being constructed. The drywall panel (not shown) can be placed vertically upon the flange 122 and against the panel guide 123 of the shelf 112 of the drywall installation tool 100, according to an embodiment. The shelf 112 can support the weight of the drywall panel and help to hold the drywall panel in place while the user secures the panel to the wall studs.

Figure 7:
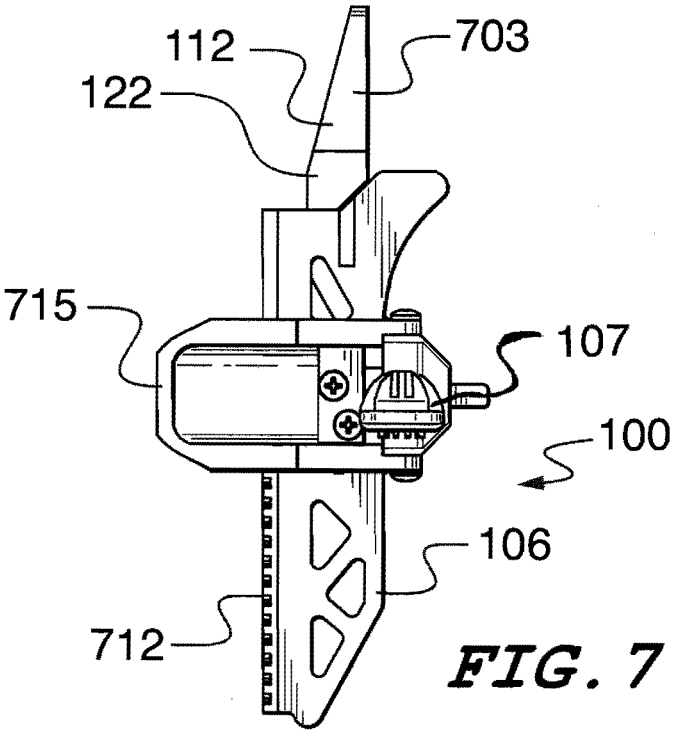
FIG. 7 is a left-side view of a drywall installation tool wherein the shelf is in an up position according to an embodiment.

FIG. 7 is a left-side view of a drywall installation tool 100 wherein the shelf 112 is shown in an "up position" 703 according to an embodiment. In an embodiment, the up position 703 can be used to allow a user to install drywall onto a ceiling. The user can position the fixed-arm 106 and the sliding-arm (not shown FIG. 6) in the proper position against the ceiling joists and can lock the drywall installation tool 100 into place using the locking lever 107. The configuration of the fixed-arm 106 can be similar to that of the sliding-arm 105 (not shown FIG. 7) in that it can comprise a fixed arm stabilizer 712 located below a fixed-arm gripping ear 715. As with the sliding-arm stabilizer 612, this fixed-arm stabilizer 712 can be configured to rest against the stud or joist to which the fixed arm gripping ear 715 has been connected, thus maintaining the position of the drywall installation tool 100 in a plane parallel to the wall or ceiling being constructed. A drywall panel (not shown in FIG. 7) can be placed horizontally on top of the flange 122 of the shelf 112. The shelf 112 can help to both support the drywall panel and hold the drywall panel in place while the user secures the panel to the ceiling joists.

Figure 8:
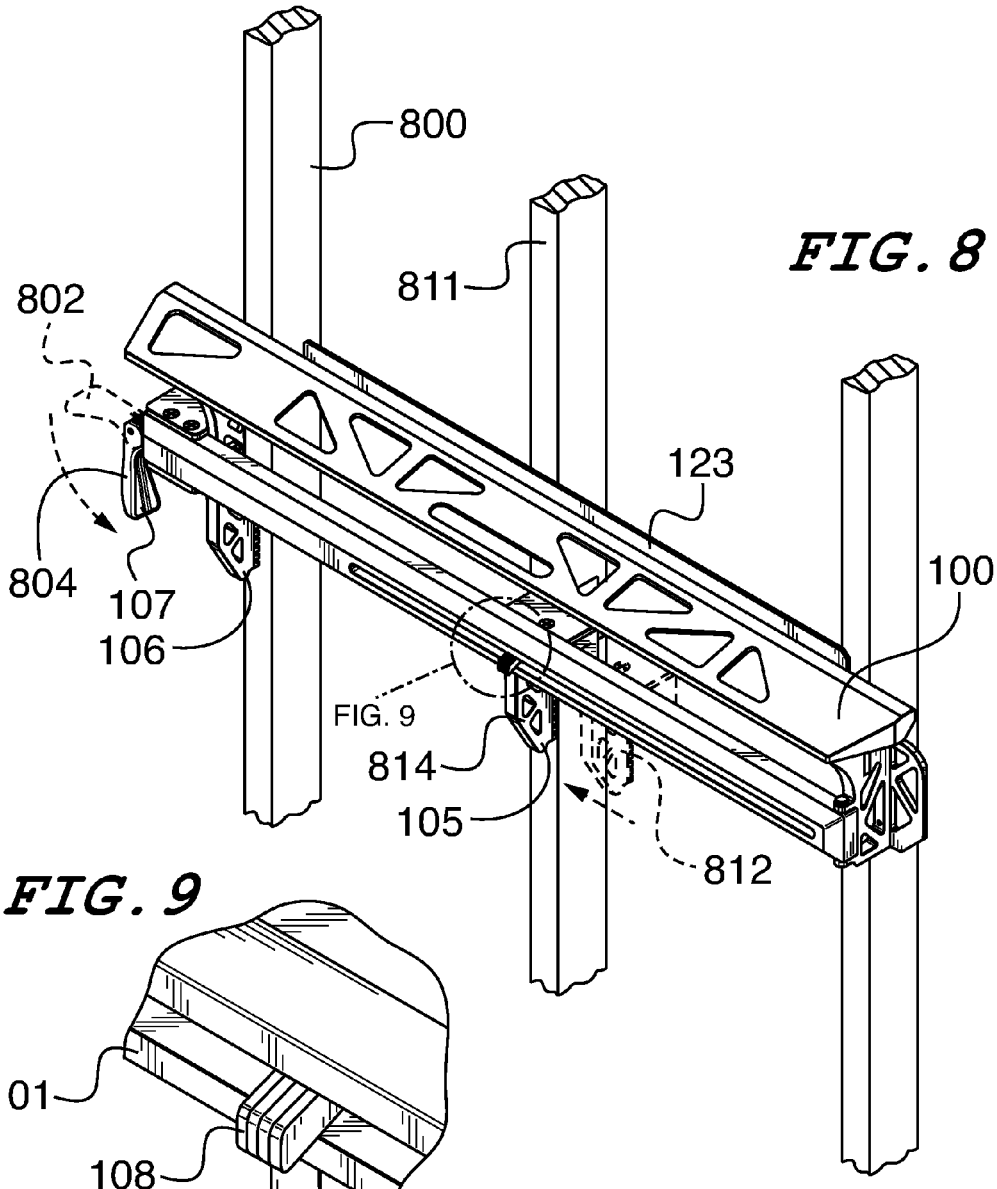
FIG. 8 is a perspective front, top and right-side view of a drywall installation tool connected to wall studs according to an embodiment.

FIG. 8 is a perspective front, top and right-side view of a drywall installation tool 100 connected to wall studs 800 according to an embodiment. In an embodiment, the drywall installation tool 100 can be placed against wall studs 800 in a position so that the panel guide 123 is flush against the front surface 811 of the wall studs 800. The fixed-arm 106 can be positioned against the front surface 811 of a wall stud 800. The sliding-arm 105 can be moved from a first position 812 to a second position 814 so as to allow the sliding-arm clamp 105 to be positioned against a chosen wall stud 800. The locking lever 107 can be moved from an open position 802 to a closed position 804, according to an embodiment. Moving the locking lever 107 to the closed position 804 can act to tighten the drywall installation tool 100 against the wall studs 800 and allows the installation tool 100 to be secured to the wall studs 800. The secured drywall installation tool 100 can be used to aid the installation of drywall panels onto wall studs 800 or ceiling joists (not shown). Similarly, the locking lever 107 can be placed in the open position 802 to allow the drywall installation tool 100 to easily be removed from the wall studs 810.

Figure 9:
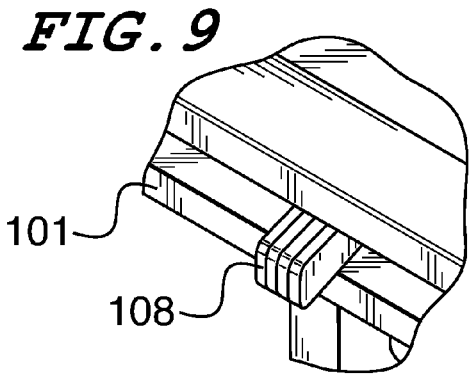
FIG. 9 is a perspective close-up view of a moveable clamp release button comprising a drywall installation tool, as shown in FIG. 8, according to an embodiment.

FIG. 9 is a perspective close-up view of a moveable clamp release button 108 comprising a drywall installation tool 100, as shown in FIG. 8, according to an embodiment. The moveable clamp release button 108 can be attached to the sliding-arm 105 (not shown in FIG. 9). The moveable clamp release button 108 can allow the sliding-arm 105 to be released from a particular position so that the sliding-arm can be moved along much of the length of the clamp section 101 as well as the draw bar 335.

Figure 10:
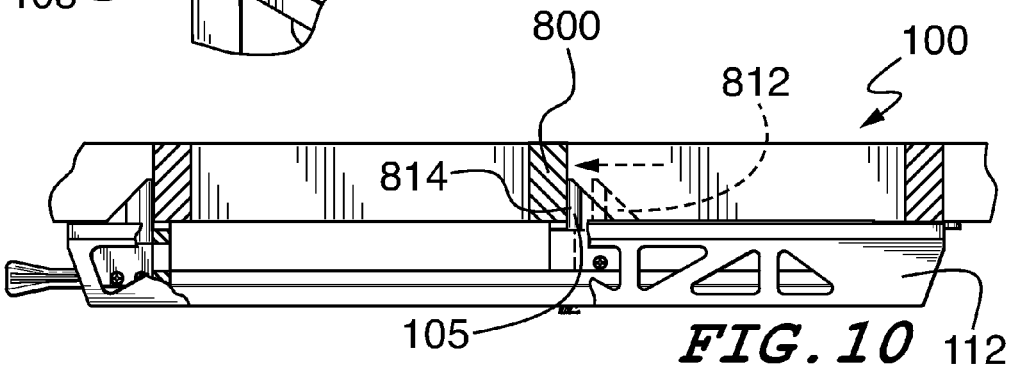
FIG. 10 is a partially cutaway top view of a drywall installation tool, as shown in FIG. 8, connected to wall studs according to an embodiment.

FIG. 10 is a top view of a drywall installation tool 100, as shown in FIG. 8, connected to wall studs 800, wherein the shelf 112 has been partially cut away, according to an embodiment. The drywall installation tool 100 can be positioned flush against the wall studs 800. The sliding-arm 105 can be moved from a first position 812 to a second position 814 so as to allow the sliding-arm 105 to be positioned against a wall stud 800.

Figure 11:
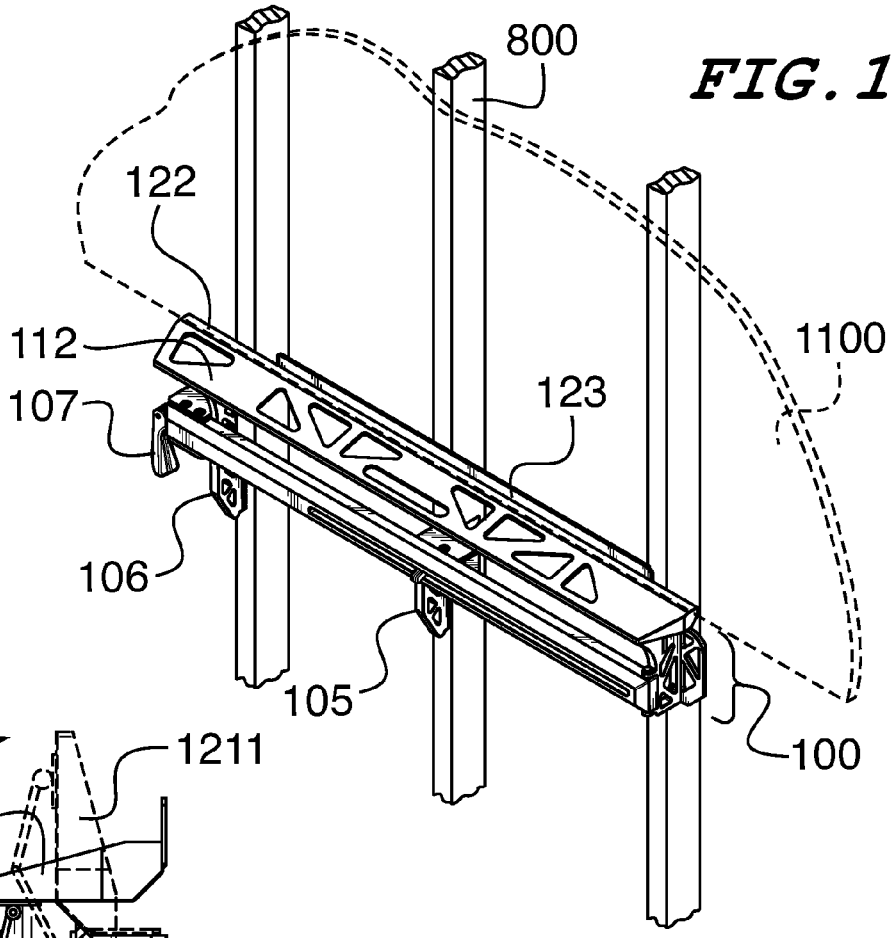
FIG. 11 is a perspective front, top and right-side view of a drywall installation tool connected to wall studs and supporting a section of drywall to be installed according to an embodiment.

FIG. 11 is a perspective front, top and side view of a drywall installation tool 100 connected to wall studs 800 and supporting a section of drywall 1100 to be installed according to an embodiment. In an embodiment, the drywall installation tool 100 can support a drywall panel 1100 to be installed onto a wall. The fixed-arm 106 and the sliding-arm 105 can be positioned against the wall studs 800. The locking lever 107 can be placed in a closed position to allow the installation tool 100 to be secured against the wall studs 800. The drywall panel 1100 can be placed vertically on the flange 122 between the shelf 112 and the panel guide 123, according to an embodiment. The installation tool 100 can hold the drywall panel 1100 in place while the user secures the drywall panel 1100 to the wall studs 800.

Figure 12:
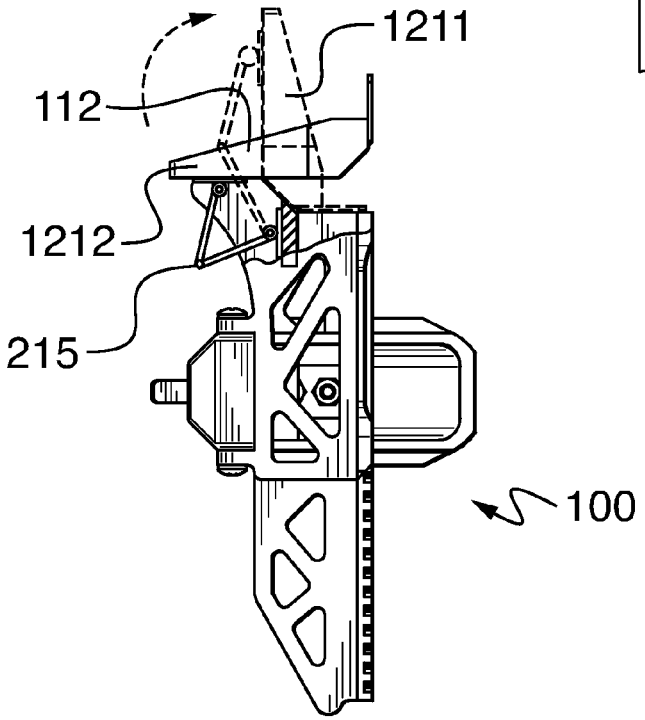
FIG. 12 is a right-side view of a drywall installation tool wherein the shelf is shown in a "down position" and, in a transparent view, is shown in an "up position" according to an embodiment.

FIG. 12 is a right-side view of a drywall installation tool 100 wherein the shelf 112 is shown in both an "up position" 1211, in a transparent view, and a "down position" 1212 according to an embodiment. According to an embodiment, the movement of the shelf 112 from the up position 1211 to the down position 1212 can be facilitated by the use of a hinge 215. This hinge 215 can be a locking hinge configured to hold the shelf 112 in either the up position 1211 or the down position 1212 unless sufficient force is applied to move it from one position to the other. In an embodiment, when the shelf 112 is positioned in the up position 1211 a drywall panel (not shown) can be placed horizontally (relative to the ground) on the shelf 112 for installation of the drywall onto a ceiling. When the shelf 112 is in the down position 1212 it can allow a drywall panel to be placed vertically (relative to the ground) on the shelf 112 for installation of the drywall onto a wall, according to an embodiment.

Figure 13:
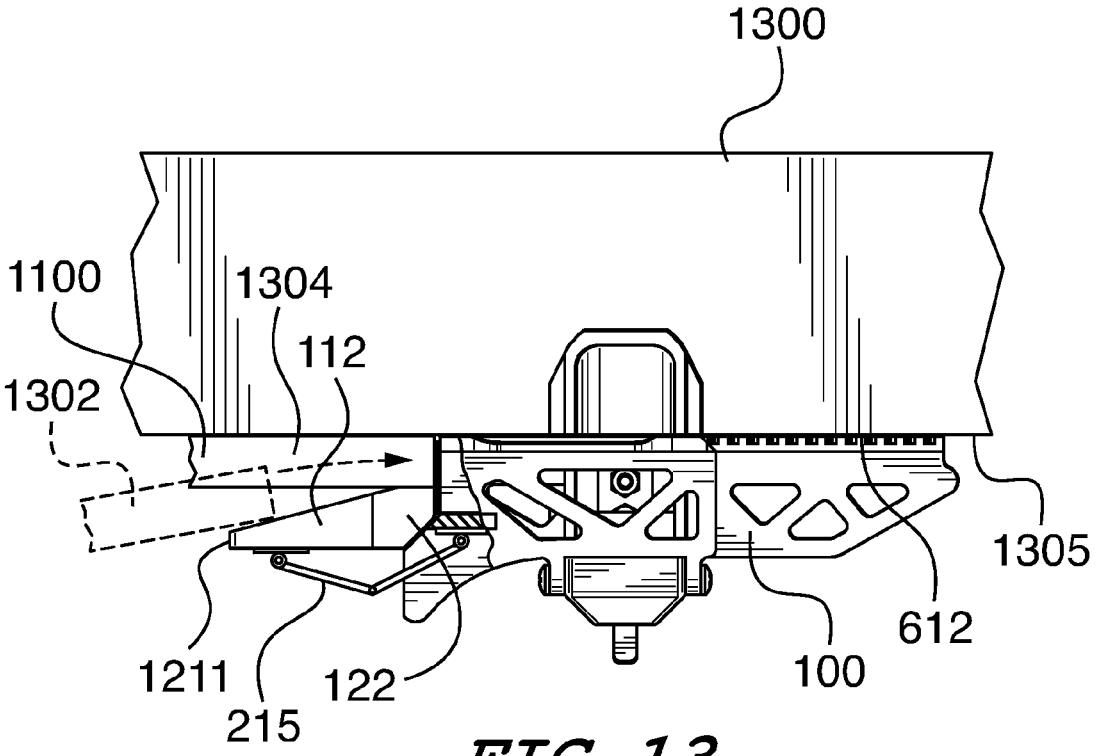
FIG. 13 is a right-side view of a drywall installation tool connected to at least one ceiling joist wherein the shelf is in the up position and a section of drywall is supported by the shelf according to an embodiment.

FIG. 13 is a right-side view of a drywall installation tool 100 connected to at least one ceiling joist 1300 wherein the shelf 112 is in the up position 1211 and a section of drywall 1100 is supported by the shelf 112 according to an embodiment. The drywall installation tool 100 can be secured to the ceiling joists 1300. In an embodiment, the shelf 112 of the drywall installation tool 100 can be positioned in the up position 1211 through use of the hinge 215. When the shelf 112 is placed in the up position 1211 it can allow the drywall panel 1100 to be positioned horizontally on the flange 122 of the shelf 112 and against the ceiling joists 1300. In an embodiment, the shelf 112 can be sloped so as to allow the drywall panel 1100 to be moved more easily into position on the flange 122. In an embodiment, the drywall panel can be slid up the slope of the shelf 112 from a position 1302 to a position 1304 above the flange 122. The installation tool 100 can allow the drywall panel 1100 to be held in place while a user can secure the drywall panel 1100 to the ceiling joists 1300. In this view the sliding-arm stabilizer 612 can be viewed positioning the drywall installation tool 100 in a plane parallel to the ceiling joist 1300 by being placed against the facing edge 1305 of the ceiling joist 1300.

Figure 14:
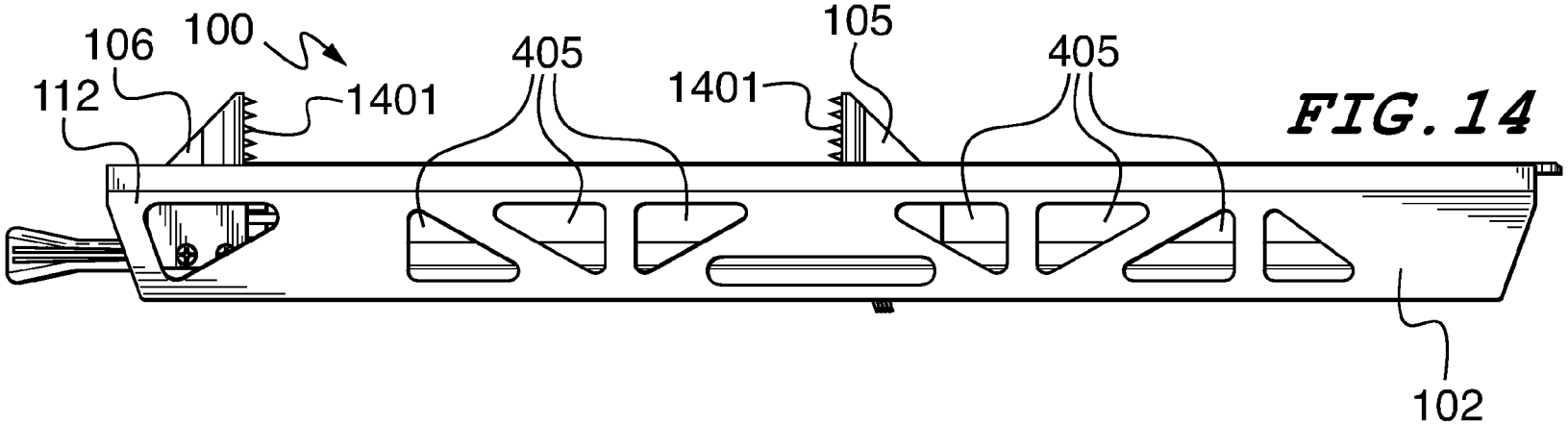
FIG. 14 is a top view of a drywall installation tool according to an alternative embodiment.

FIG. 14 is a top view of an alternative embodiment of a drywall installation tool 100 according to an embodiment. In this embodiment, both the sliding-arm 105 and the fixed-arm 106 can comprise spikes 1401 which can be designed to penetrate and better grip the studs, joists or similar structures to which the drywall installation tool 100 is to be attached. In addition to spikes 1401, any similar structure capable of improving the gripping ability of the sliding-arm 105 and fixed-arm 106 are contemplated as being part of the present invention. Such structures can include blades, nodules, and cylinders to name a few.

Figure 15:
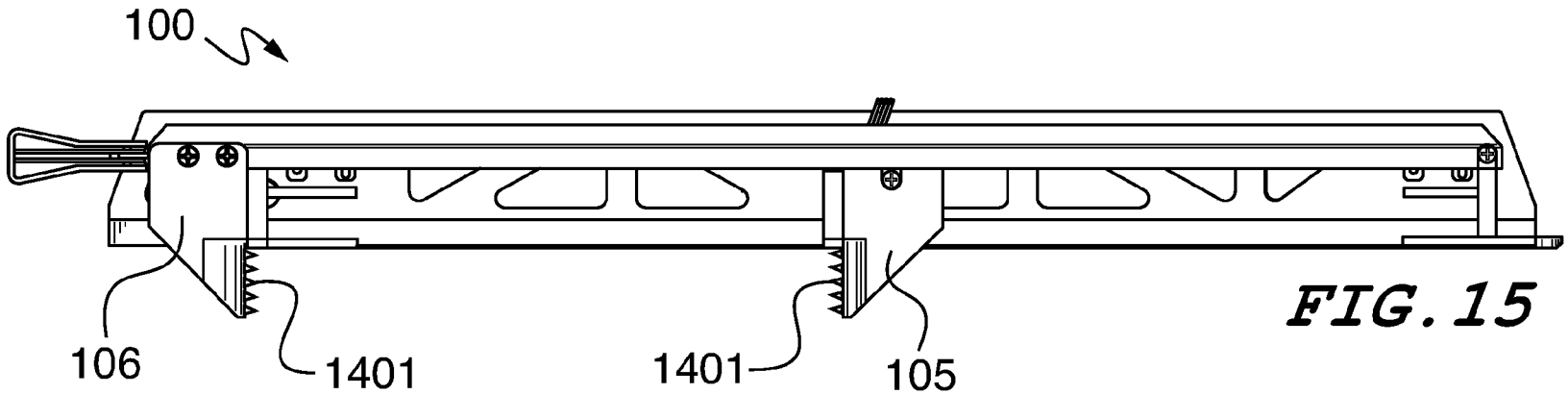
FIG. 15 is a bottom view of a drywall installation tool according to an alternative embodiment.

FIG. 15 is a bottom view of the alternative embodiment of a drywall installation tool 100 shown in FIG. 14 according to an embodiment. This view shows the same spikes 1401 from the bottom view.

Although the present drywall installation tool has been described in terms of exemplary embodiments, it is not limited thereto. Rather, the appended claims should be construed broadly, to include other variants and embodiments of the device, which may be made by those skilled in the art without departing from the scope and range of equivalents of the present inventive concept.

What is claimed is:

1. A drywall installation tool comprising:

a clamping section comprising a horizontal bar substantially the same length as the clamping section;

at least one fixed-arm immovably connected to the horizontal bar, and at least one sliding-arm movably connected to the horizontal bar;

a shelf section comprising a shelf substantially the same length as and parallel to the clamping section having an inner edge and an outer edge; and a locking mechanism, comprising a locking lever, configured to securely connect the sliding-arm at chosen points along the length of the horizontal bar.

2. A drywall installation tool as recited in claim 1 wherein the shelf comprises a flange along its inner edge.

3. A drywall installation tool as recited in claim 2 wherein the shelf slopes downward from the flange to the outer edge.

4. A drywall installation tool as recited in claim 1 wherein the shelf comprises a panel guide along its inner edge.

5. A drywall installation tool as recited in claim 1 wherein the fixed-arm comprises at least one fixed-arm grip and the sliding-arm comprises at least one sliding-arm grip.

6. A drywall installation tool as recited in claim 5 wherein both the fixed-arm grip and the sliding arm grip comprise one or more spikes.

7. A drywall installation tool as recited in claim 1 wherein the horizontal bar comprises a draw bar and the sliding-arm comprises a draw bar locking mechanism configured to removably connect the sliding-arm to the draw bar and the horizontal bar.

8. A drywall installation tool as recited in claim 1 wherein the sliding-arm comprises a sliding-arm stabilizer and the fixed-arm comprises a fixed-arm stabilizer.

9. A drywall installation tool comprising:

a clamping section comprising a horizontal bar substantially the same length as the clamping section;

at least one fixed-arm immovably connected to the horizontal bar, and at least one sliding-arm movably connected to the horizontal bar;

a shelf section comprising a shelf substantially the same length as and parallel to the clamping section having an inner edge and an outer edge, wherein the shelf section is configured to pivot between an up position to a down position; and a locking mechanism, comprising a locking lever, configured to securely connect the sliding-arm at chosen points along the length of the horizontal bar.

10. A drywall installation tool as recited in claim 9 wherein the shelf comprises a flange along its inner edge.

11. A drywall installation tool as recited in claim 10 wherein the shelf slopes downward from the flange to the outer edge.

12. A drywall installation tool as recited in claim 9 wherein the shelf comprises a panel guide along its inner edge.

13. A drywall installation tool as recited in claim 9 wherein the fixed-arm comprises at least one fixed-arm grip and the sliding-arm comprises at least one sliding-arm grip.

14. A drywall installation tool as recited in claim 13 wherein both the fixed-arm grip and the sliding arm grip comprise one or more spikes.

15. A drywall installation tool as recited in claim 9 wherein the horizontal bar comprises a draw bar and the sliding-arm comprises a draw bar locking mechanism configured to removably connect the sliding-arm to the draw bar and the horizontal bar.

16. A drywall installation tool as recited in claim 9 wherein the sliding-arm comprises a sliding-arm stabilizer and the fixed-arm comprises a fixed-arm stabilizer.

17. A drywall installation tool as recited in claim 9 wherein the shelf section comprises a hinge.

* * * * *